US008127418B2

(12) United States Patent
Bertelsen et al.

(10) Patent No.: US 8,127,418 B2
(45) Date of Patent: Mar. 6, 2012

(54) APPARATUS FOR MANUFACTURING STRUCTURES WITH A CONTINUOUS SIDEWALL

(76) Inventors: Larry Bertelsen, Lloydminster (CA); Alan Kingsley, Calgary (CA); Richard A. Roen, Centennial, CO (US)

( * ) Notice: Subject to any disclaimer, the term of this patent is extended or adjusted under 35 U.S.C. 154(b) by 1122 days.

(21) Appl. No.: 11/855,320

(22) Filed: Sep. 14, 2007

(65) Prior Publication Data

US 2008/0066285 A1 Mar. 20, 2008

(51) Int. Cl.
*B25B 27/14* (2006.01)
*E04G 21/00* (2006.01)

(52) U.S. Cl. ..... 29/281.4; 29/281.1; 29/281.5; 29/429; 29/469; 228/48; 219/126; 52/745.01; 182/128

(58) Field of Classification Search ..... 29/281.1, 29/281.4, 281.5, 429, 468, 469; 228/184, 228/47.1, 48; 219/59.1, 79, 126; 52/745.01; 182/37, 128
See application file for complete search history.

(56) References Cited

U.S. PATENT DOCUMENTS 1,134,061 A * 3/1915 Power ..... 182/145
1,197,689 A 9/1916 Van Osdel
1,699,544 A * 1/1929 Rohlfing ..... 182/14
1,872,810 A 8/1932 Raymond
2,605,540 A * 8/1952 Kroll et al. ..... 29/429
2,623,643 A * 12/1952 Seamans ..... 212/179
2,638,524 A * 5/1953 Meyer ..... 219/126
2,751,672 A * 6/1956 Reed ..... 29/429
2,794,242 A * 6/1957 Evers et al. ..... 29/429
2,794,901 A * 6/1957 Christensen et al. ..... 219/126
2,960,053 A * 11/1960 Meyer ..... 228/32
3,199,839 A * 8/1965 Linder et al. ..... 254/89 R
3,380,147 A * 4/1968 McDonald ..... 228/145
3,436,518 A 4/1969 Persson
3,466,723 A * 9/1969 Durand ..... 29/897.33
3,653,395 A 4/1972 Chapman
3,673,754 A * 7/1972 Murashige et al. ..... 52/745.17
3,734,387 A * 5/1973 Sannipoli ..... 228/6.1
3,789,565 A * 2/1974 Lindholm ..... 52/745.01
3,838,496 A * 10/1974 Kelly ..... 228/213
3,851,736 A * 12/1974 Westlake et al. ..... 52/745.2
3,906,700 A 9/1975 Fujiwara et al.
3,935,633 A 2/1976 Bunker
3,966,533 A * 6/1976 Goldsworthy et al. .... 156/379.8
4,074,847 A 2/1978 McFatter
4,121,747 A 10/1978 McFatter
4,142,284 A 3/1979 Steuber
4,177,915 A 12/1979 Blankenburg
4,432,128 A * 2/1984 Pechacek et al. ..... 29/429
4,494,291 A 1/1985 Morrison
(Continued)

FOREIGN PATENT DOCUMENTS

CA 1 096 576 3/1981
(Continued)

*Primary Examiner* — Essama Omgba
(74) *Attorney, Agent, or Firm* — Albert Haegele; Leyendecker & Lemire, LLC

(57) ABSTRACT

An apparatus for manufacturing structures having a continuous sidewall includes a stationary inner work station having at least one working level and a stationary outer work station having at least one working level. The outer work station surrounds the inner work station. A shaft is disposed between the inner work station and the outer work. A lift or hoist is provided for raising and lowering a work piece in the shaft as work progresses.

18 Claims, 4 Drawing Sheets

U.S. PATENT DOCUMENTS

| | | | | |
|---|---|---|---|---|
| 4,523,076 | A * | 6/1985 | Laymon | 219/125.1 |
| 4,599,123 | A | 7/1986 | Christensson | |
| 4,618,757 | A * | 10/1986 | Cabany et al. | 219/60 R |
| 4,636,645 | A | 1/1987 | Kessinger | |
| 4,664,307 | A | 5/1987 | Curry et al. | |
| 4,964,497 | A * | 10/1990 | Bundo et al. | 198/341.02 |
| 5,921,459 | A * | 7/1999 | Heraly et al. | 228/45 |
| 6,153,853 | A * | 11/2000 | Maruyama et al. | 219/121.63 |
| 6,164,872 | A | 12/2000 | Morishige | |
| 6,245,284 | B1 * | 6/2001 | Cooper, Sr. | 266/61 |
| 6,266,862 | B1 | 7/2001 | Oostwouder et al. | |
| 6,282,863 | B1 | 9/2001 | Christian et al. | |
| 6,539,602 | B1 * | 4/2003 | Ozawa et al. | 29/402.11 |
| 6,715,243 | B1 * | 4/2004 | Fons | 52/192 |
| 6,843,030 | B2 * | 1/2005 | Zingerman | 52/123.1 |
| 6,948,720 | B1 * | 9/2005 | Carlson | 279/5 |
| 7,500,592 | B1 * | 3/2009 | Petricio Yaksic | 228/184 |
| 2008/0256776 | A1 * | 10/2008 | Neuhaus et al. | 29/446 |

FOREIGN PATENT DOCUMENTS

| | | | |
|---|---|---|---|
| CA | 1 180 160 | | 1/1985 |
| CA | 2 479 412 | A1 | 2/2006 |
| ES | 2 134 107 | | 9/1999 |
| GB | 528401 | | 10/1940 |
| GB | 800822 | | 9/1958 |
| GB | 833964 | | 5/1960 |
| GB | 842272 | | 7/1960 |
| GB | 948672 | | 2/1964 |
| GB | 1135769 | | 12/1968 |
| GB | 1155491 | | 6/1969 |
| GB | 1 500 498 | | 2/1978 |
| JP | 59066981 | | 4/1984 |
| JP | 2104871 | | 4/1990 |
| JP | 7034711 | | 2/1995 |
| JP | 8004351 | | 1/1996 |
| JP | 11152180 | | 6/1999 |
| JP | 2002038545 | | 2/2002 |
| WO | WO-02/087804 | A1 | 11/2002 |

* cited by examiner

APPARATUS FOR MANUFACTURING STRUCTURES WITH A CONTINUOUS SIDEWALL

FIELD

The present invention relates to an apparatus for manufacturing structures with a continuous side wall, such a storage tanks and vessels, grain elevators and the like.

BACKGROUND

U.S. Pat. No. 1,872,810 (Raymond 1932) and Canadian Patent 2,479,412 (Bertelsen 2004) disclose a mode of construction in which multi-stage work pieces are constructed in shafts.

SUMMARY

There is provided an apparatus for manufacturing structures with a continuous side wall, which includes a stationary inner work station having at least one working level and a stationary outer work station having at least one working level. The outer work station surrounds the inner work station. A shaft is disposed between the inner work station and the outer work station. Means are provided for raising and lowering a work piece in the shaft.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
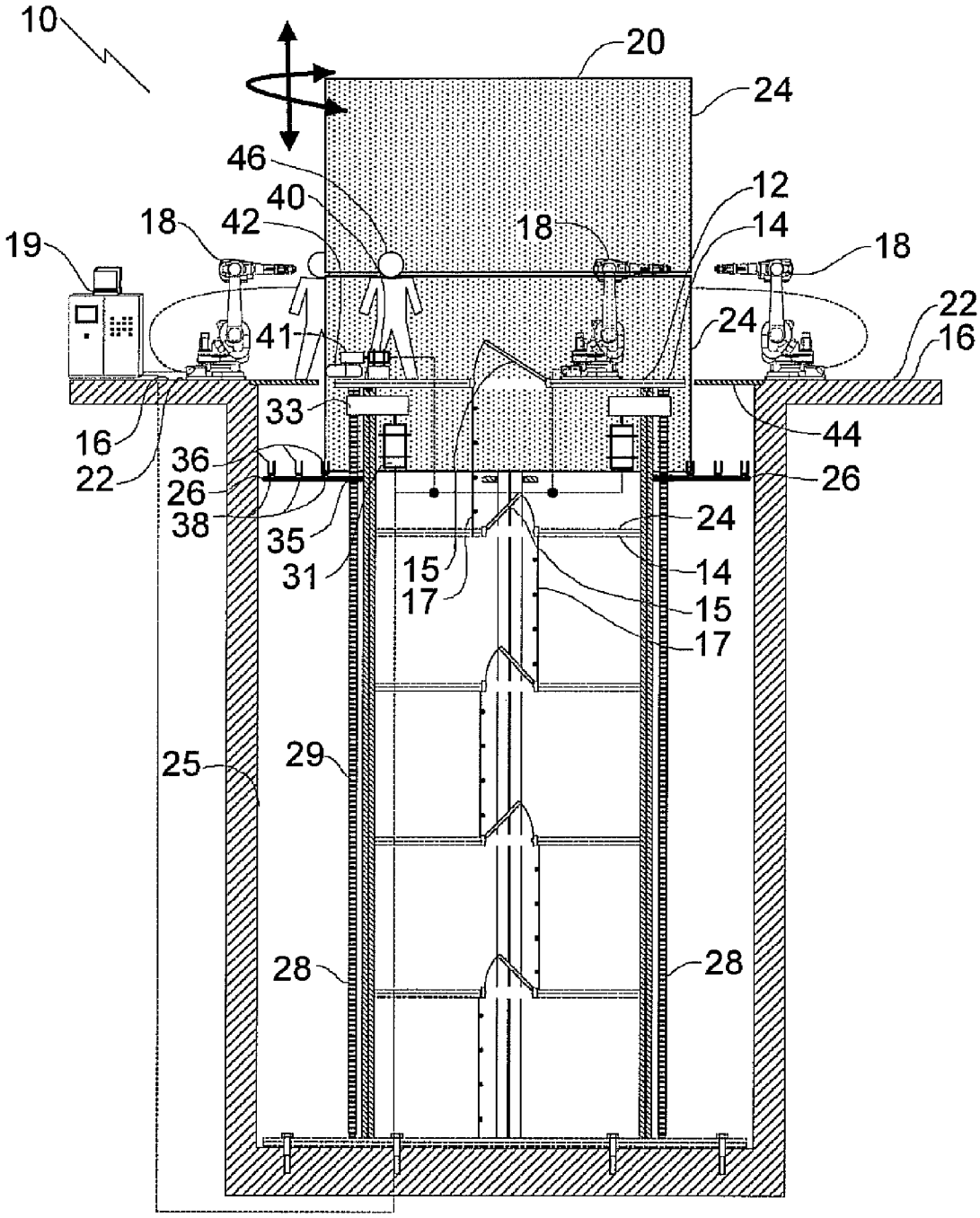
FIG. 1 is a side elevation view, in section, of an apparatus for manufacturing structures having a continuous sidewall.

The preferred embodiment, an apparatus for manufacturing structures having a continuous side wall generally identified by reference numeral 10, will now be described with reference to FIG. 1 through 6.

Structure and Relationship of Parts:

Referring to FIG. 1, apparatus 10 includes a stationary inner work station 12 having multiple working levels 14, and a stationary outer work station 16. Outer work station 16 surrounds inner work station 12. Working levels 14 are accessed by hatches 15 and ladders 17. Inner work station 12 and outer work station 16 have robots 18 performing tasks to assemble the work piece 20, such as welding, cutting, grinding, or non-destructive testing. Robots 18 are preferably six axis industrial robots, and controlled by a controller 19. It will be understood that, while stationary outer work station 16 is shown with only one working level 22, more than one working level may be included. Additional working levels allow multiple sections 24 of work piece 20 to be worked on at a time, or to access sections not currently being worked on. In addition, inner work station 12 may be removable to allow work to be done on other types of work pieces 20, where inner work station 12 would be inappropriate. It will be understood that work piece 20 may be any structure with a continuous wall, such as cylindrical, oblong, oval, square, rectangular, or the like. As a cylindrical work piece 20 is shown in the accompanying drawings, and discussed below as the example only. Those skilled in the art will be aware that modifications may be made to accommodate structures, that are other than cylindrical.

Figure 3:
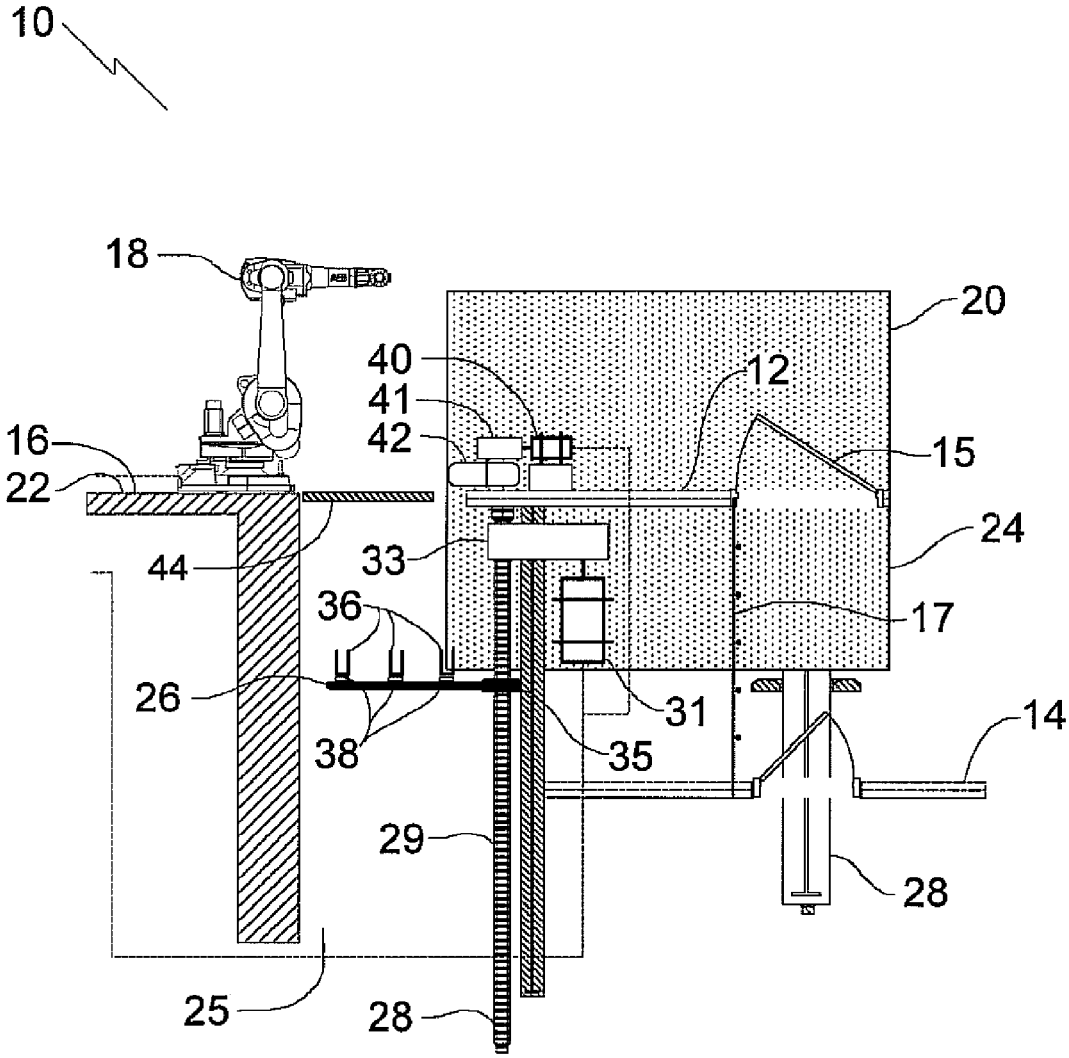
FIG. 3 is a detailed side elevation view, in section, of an inner and outer work stations.
Figure 4:
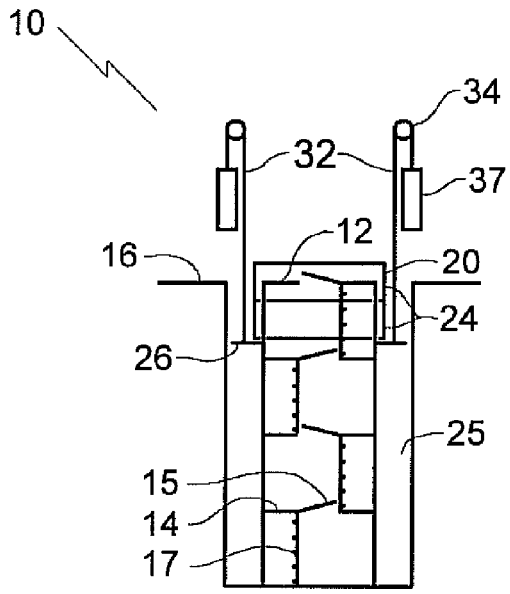
FIG. 4 is a side elevation view, in section, of the apparatus with an alternative lift.
Figure 5:
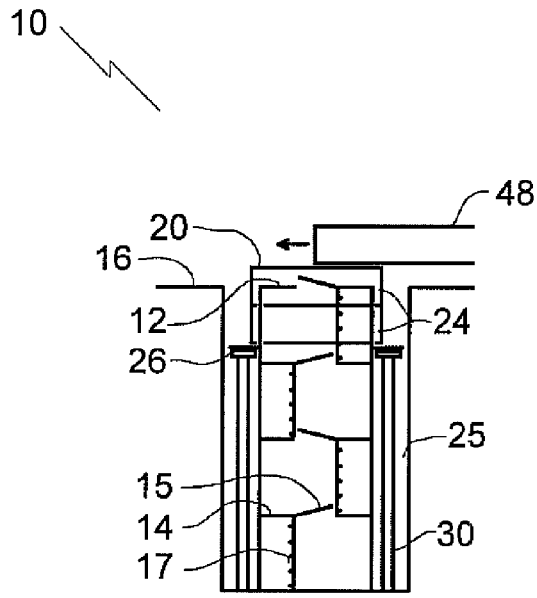
FIG. 5 is a side elevation view, in section, of the apparatus using straights or coiled steel.
Figure 6:
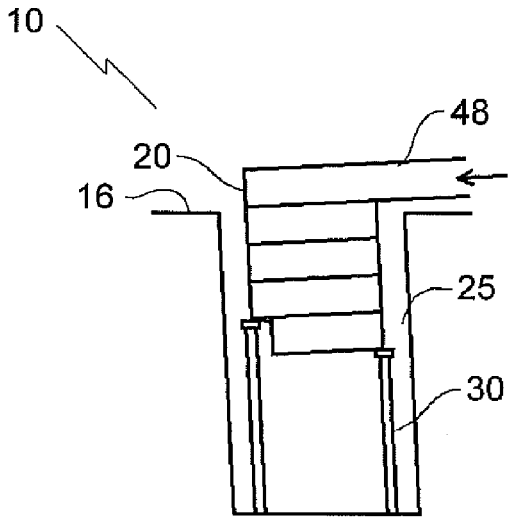
FIG. 6 is a side elevation view, in section, of the apparatus using coiled steel at an angle.

Referring to FIG. 3, a shaft 25 is disposed between inner work station 12 and outer work station 16, with a platform 26 for raising and lowering work piece 20 in annular shaft 25 as work progresses. While an annular shaft is shown to fabricate cylindrical work piece 20, it will be understood that the shape of shaft 25 and other components, such as work stations 12 and 16 may require modification depending on the shape of the work pieces that will be fabricated. A further variation of shaft 25 will be discussed below with respect to an inclined shaft as shown in FIG. 6. Shaft 25 may be dug into the ground or constructed above ground, as circumstances dictate. It may also be desirable to build shaft 25 into a hill. Platform 26 is raised by ball screws 28 distributed about platform 26 within shaft 25 so as to equally distribute the weight of work piece 20. Ball screw 28 includes a screw portion 29 driven by a motor 31 and transmission 33. Screw portion 29 rotates within a nut 35 attached to platform 26. It will be recognized that other lifts may also be used, either from below or above. Examples include one or more hydraulic rams 30 that would apply force from below as shown in FIG. 5, a gears and sprockets arrangement (not shown), or platform 26 may be raised from above, such as by using lifting chains or belts 32 distributed radially about platform 26 as shown in FIG. 4. These lifting systems may be supplemented using pulleys 34, counterweights 37, or the like, as is known in the art. If platform 26 is not used the lifting systems may be attached directly to work piece 20.

Figure 2:
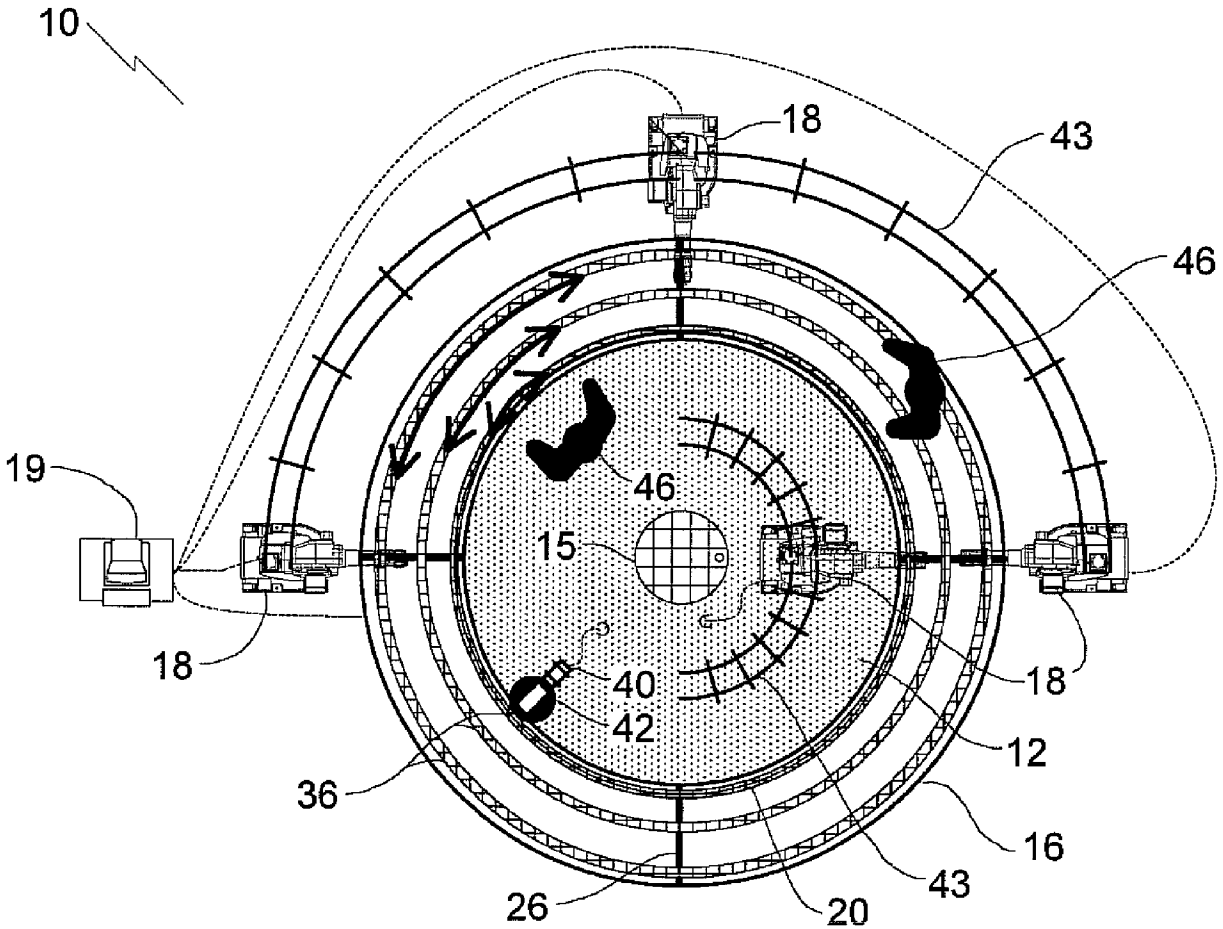
FIG. 2 is a top plan view of the apparatus of FIG. 1.

Referring to FIG. 2, as work piece 20 is raised on platform 26, it may also be rotated to improve access to the entire work piece 20. The movement of workpiece 20 vertically and its rotation are coordinated by controller 19, which also controls robots 18, such that the entire system may be automated. Platform 26 includes various work piece holders 36, which correspond to various sizes of work pieces 20. Referring to FIG. 3, the work piece holders 36 are then mounted on bearings 38, and a motor 40 and transmission 41 driving a wheel 42 that engages the sides of work piece 20 to cause it to rotate. While bearings have been illustrated as a rolling mechanism, there are many possible means for rotating work piece 20, such as bushings, rollers, or the like. In addition, it will be recognized that work piece 20 may be made rotatable in other ways. For example, by providing bearings in platform 26 itself between two overlapping horizontal sections, or between two abutting horizontal sections. Referring to FIG. 2, in addition to rotating work piece 20, robots 18 may be mounted on servo tracks 43 to allow them to move about work piece 20 as well.

As mentioned above, apparatus 10 is designed to accommodate different sizes and shapes of work pieces 20. Referring to FIG. 1, this is done by providing work piece holders 36 at different distances along platform 26. In addition, an adjustable floor 44 is provided on outer work station 16 to provide access to work piece 20, and ensure the safety of workers 46. Adjustable floor 44 may be in the form of removable rings of various sizes, depending on the application.

Work piece 20 may be fabricated using preformed sections 24, where the vertical seam has been previously welded. Referring to FIG. 5, it may also be fabricated using straight or coil steel 48. Straight or coil steel 48 may be fed horizontally onto work piece 20 for each section, or preformed immediately prior to being placed on work piece 20. In this case, the vertical seam (if required) would also be welded by robots 18 or workers 46. Referring to FIG. 6, straight or coil steel 48 may also be fed continuously at an angle, which would eliminate the vertical seams. If at an angle, shaft 25 may also be positioned at an angle to facilitate the fabrication process.

Operation:

The method of fabricating a cylindrical structure using the apparatus described above with reference to FIG. 1 through 6 will now be discussed. Referring to FIG. 1, the process starts by placing a section 24 of work piece 20 on platform 26 in the appropriate work piece holder 36. Work piece 20 is then lowered using ball screws 28 to the appropriate height, and another section 24 of work piece 20 is positioned on top. Robots 18 or workers 46 positioned at inner work stations 12 and outer work stations 16 proceed to attach the two sections 24, based on the commands from controller 19 in the case of robots 18. As work proceeds, work piece 20 may be rotated by motor 40 via transmission 41 driving wheel 42, of which there may be more than one, to cause work piece 20 or platform 26 to rotate, and, referring to FIG. 2, robots 18 may move along servo tracks 43. Referring to FIG. 1, work piece 20 is lowered again for the next section 24 to be attached, with the rotation and vertical movement of work piece 20 being coordinated with robots 18 by controller 19. The process continues until all sections 24 of workpiece 20 have been attached. The final section to be attached may be an end piece. Access to lower sections 24 of workpiece 20 is provided via hatches 15 and ladders 17 for inspection, testing, or further work. Once all sections have been satisfactorily attached, work piece 24 is removed by raising platform 26 and using, for example, a crane (not shown) to remove work piece 24. Work piece 20 may then be installed on its other end, which could not be positioned previously due to the presence of inner work station 12. Referring to FIG. 6, if coil steel 48 is used and run on at an angle, work piece 20 may be continuously lowered as the seam is sealed by welding, rather than in the stepwise fashion described above.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the claims.

What is claimed is:

1. An apparatus for manufacturing structures having a continuous sidewall, comprising: a stationary inner work station having at least one working level; a stationary outer work station having at least one working level, the outer work station surrounding the inner work station; an annular shaft disposed between the inner work station and the outer work station; the annular shaft comprising means for rotating a work piece, and a platform for raising and lowering the work piece in the shaft as work progresses, the platform being raised and lowered by a lift.

2. The apparatus as defined in claim 1, wherein at least one of the inner work station or the outer work station has at least one robot performing at least one of the functions of welding, cutting, grinding, or non-destructive testing.

3. The apparatus as defined in claim 2, wherein operation of the means for rotating the work piece is coordinated with the at least one robot.

4. The apparatus as defined in claim 1, wherein the platform has said means for rotating the work piece.

5. The apparatus as defined in claim 4, wherein the means for rotating the work piece are selected from the group consisting of bearings, bushings and rollers.

6. The apparatus as defined in claim 4, wherein the means for rotating the work piece includes a motor.

7. The apparatus as defined in claim 1, wherein the platform includes at least one work piece holder between the inner work station and the outer work station for holding the work piece.

8. The apparatus as defined in claim 1, wherein the lift is selected from the group consisting of: at least one hydraulic ram, more than one ball screw distributed radially about the platform, more than one lifting chain distributed radially about the platform, a hoisting mechanism, gears and sprockets, and more than one lifting belt distributed radially about the platform.

9. The apparatus of claim 1, wherein the shaft is at an angle.

10. The apparatus of claim 1, wherein the shaft is substantially vertical.

11. The apparatus of claim 1, wherein the stationary outer work station has an adjustable work surface to accommodate different sizes of work pieces.

12. The apparatus of claim 1, wherein the platform can support different sizes, shapes and weights of work pieces.

13. An apparatus for manufacturing structures with continuous sidewalls, comprising: a stationary inner work station having at least one working level; a stationary outer work station having at least one working level, at least one of the inner work station and the outer work station has at least one robot performing at least one of the functions of welding, cutting, grinding, or non-destructively testing; a substantially vertical annular shaft disposed between the inner work station and the outer work station; a platform raised and lowered by a lift for raising and lowering a work piece in the annular shaft as work progresses, the platform having bearings for rotating the work piece; and a motor for rotating the work piece along the bearings, the operation of the motor being coordinated with the operation of the at least one robot.

14. An apparatus for manufacturing structures having a continuous sidewall, comprising:

an annular shaft residing in the ground;

a stationary inner work station residing at a top of the annular shaft, the top of the annular shaft encircling the stationary inner work station;

a stationary outer work station, the stationary outer work station residing at the top of the annular shaft; and a hoist adapted to lower a work piece into the annular shaft, the hoist residing in the annular shaft and comprising a platform adapted to support the work piece.

15. The apparatus of claim 14, further comprising a plurality of six axis industrial robots, at least one of the plurality of six axis industrial robots residing on the outer work station and being adapted to translocate thereupon, and at least one other of the plurality six axis industrial robots residing on the inner work station and being adapted to translocate thereupon.

16. A combination including the apparatus of claim 14, further comprising a hollow cylindrical work piece, wherein;

the hollow cylindrical work piece comprises a bottom portion, the bottom portion being supported by the platform and residing within the annular shaft;

the stationary inner work station resides inside the hollow cylindrical work piece; and the stationary outer work station resides outside the hollow cylindrical work piece.

17. The combination of claim 16, wherein the hoist is further adapted to rotate the hollow cylindrical work piece about an axis of cylinder of the hollow cylindrical work piece.

18. The combination of claim 17, further comprising a six axis industrial robot disposed on the outer work station, wherein the six axis industrial robot is adapted to revolve about the axis of cylinder of the hollow cylindrical work piece.

* * * * *